US006797871B2

(12) United States Patent
Atkin

(10) Patent No.: US 6,797,871 B2
(45) Date of Patent: Sep. 28, 2004

(54) STRINGED INSTRUMENT STRUMMING/PICKING APPARATUS AND METHOD

(76) Inventor: Greg M. Atkin, 414 E. Wilken Way, Anaheim, CA (US) 92802

( * ) Notice: Subject to any disclaimer, the term of this patent is extended or adjusted under 35 U.S.C. 154(b) by 0 days.

(21) Appl. No.: 09/872,655

(22) Filed: Jun. 1, 2001

(65) Prior Publication Data

US 2002/0178891 A1 Dec. 5, 2002

(51) Int. Cl.[7] ..... G10D 3/16
(52) U.S. Cl. ..... 84/322; 84/320
(58) Field of Search ..... 84/320, 321, 322

(56) References Cited

U.S. PATENT DOCUMENTS

| | | | | |
|---|---|---|---|---|
| 557,293 A | | 3/1896 | Wahl | |
| 756,348 A | | 4/1904 | Forney | |
| 1,009,403 A | | 11/1911 | Gaynor | |
| 1,184,561 A | | 5/1916 | Napoletano | |
| 1,254,577 A | | 1/1918 | Carpenter et al. | |
| 1,263,740 A | | 4/1918 | Burdwise | |
| 1,461,070 A | | 7/1923 | Rudesyle | |
| 1,557,476 A | | 10/1925 | Kimball et al. | |
| 1,573,912 A | | 2/1926 | Burdwise | |
| 1,787,136 A | | 12/1930 | Beauchamp | |
| 2,045,571 A | | 6/1936 | Dopyera | 84/422 |
| 2,063,011 A | | 12/1936 | Bell | 84/322 |
| 3,112,668 A | | 12/1963 | Moshay | 84/322 |
| 3,648,558 A | | 3/1972 | Chenette | 84/322 |
| 3,650,172 A | | 3/1972 | Osborne | 84/322 |
| 3,789,720 A | | 2/1974 | McIntyre | 84/322 |
| 3,992,975 A | * | 11/1976 | Gallagher | 84/322 |
| 4,015,502 A | | 4/1977 | Strong | 84/322 |
| 4,020,732 A | | 5/1977 | Kelly | 84/322 |
| 4,102,234 A | | 7/1978 | Brundage | 84/322 |
| 4,122,746 A | | 10/1978 | Freeman | 84/322 |
| 4,150,601 A | | 4/1979 | Henley, Jr. | 84/322 |
| 4,228,719 A | | 10/1980 | Keene | 84/322 |
| 4,270,433 A | | 6/1981 | Adamec | 84/322 |
| 4,347,773 A | | 9/1982 | Zook | 84/322 |
| 4,497,237 A | | 2/1985 | Beall | 84/322 |
| 4,625,615 A | | 12/1986 | Lukehart | 84/322 |
| 4,625,616 A | | 12/1986 | McVicker | 84/322 |
| 4,691,609 A | | 9/1987 | Acocella | 84/322 |
| 4,711,150 A | | 12/1987 | Hyduck | 84/322 |
| 4,741,239 A | | 5/1988 | Crafton | 84/322 |
| 4,843,942 A | | 7/1989 | Ishizuka | 84/322 |
| 4,867,032 A | | 9/1989 | Lukehart | 84/322 |
| 4,879,940 A | | 11/1989 | Pereira | 84/322 |
| 4,993,302 A | | 2/1991 | Jonathan | 84/322 |
| 5,307,723 A | | 5/1994 | De La Rosa | 84/322 |
| 5,323,677 A | | 6/1994 | Knutson | 84/322 |
| 5,341,715 A | | 8/1994 | Hucek | 84/322 |
| 5,509,341 A | | 4/1996 | Dunlop | 84/322 |
| 5,587,542 A | | 12/1996 | Everly | 84/322 |
| 5,594,189 A | | 1/1997 | Latteri | 84/322 |
| 5,610,349 A | | 3/1997 | Fogarty et al. | 84/322 |
| 5,648,622 A | | 7/1997 | Storey | 84/322 |
| 5,837,913 A | * | 11/1998 | Newman | 84/329 |
| 5,859,377 A | | 1/1999 | Mackey et al. | 84/322 |
| 5,981,857 A | * | 11/1999 | Mapson | 84/322 |
| 6,040,512 A | | 3/2000 | Polley | 84/322 |
| 6,054,643 A | | 4/2000 | Chance et al. | 84/322 |

* cited by examiner

*Primary Examiner*—Kimberly Lockett
(74) *Attorney, Agent, or Firm*—Myers Dawes Andras & Sherman LLP

(57) ABSTRACT

A pick apparatus is adapted for use by a player having a thumb with a meatus, to strum/pick strings of a musical instrument. The apparatus includes a pick adapted to be held by the player and to be moved in a contacting and strumming relationship with the strings of the musical instrument. A sleeve is provided for disposition on the thumb of the player. Attachment means are contemplated to releasably attach the pick to the sleeve with the pick being movable between an extended position facilitating strumming/picking, and a retracted position facilitating finger picking of the strings. The pick and attachment means can be disposed exteriorly of the sleeve, or interiorly of the sleeve with a portion of the pick extending through an opening in the sleeve. A pivot pad having an axis includes a first surface having a first taper along the axis and a second taper transverse to the axis.

25 Claims, 7 Drawing Sheets

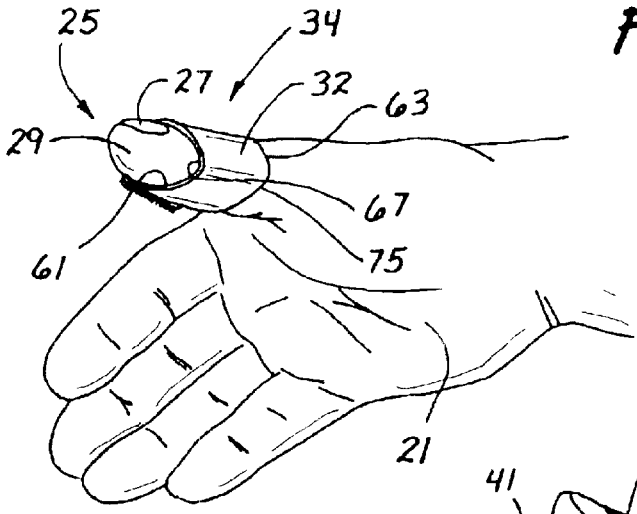
Fig. 4
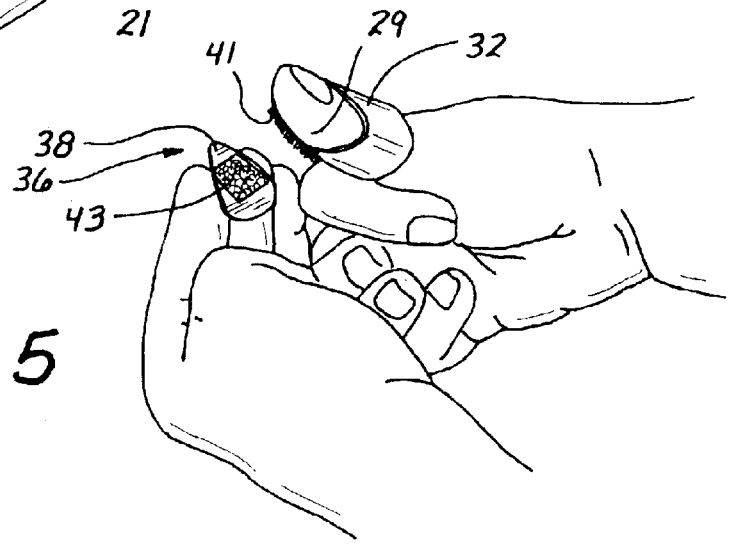
Fig. 5
Fig. 6
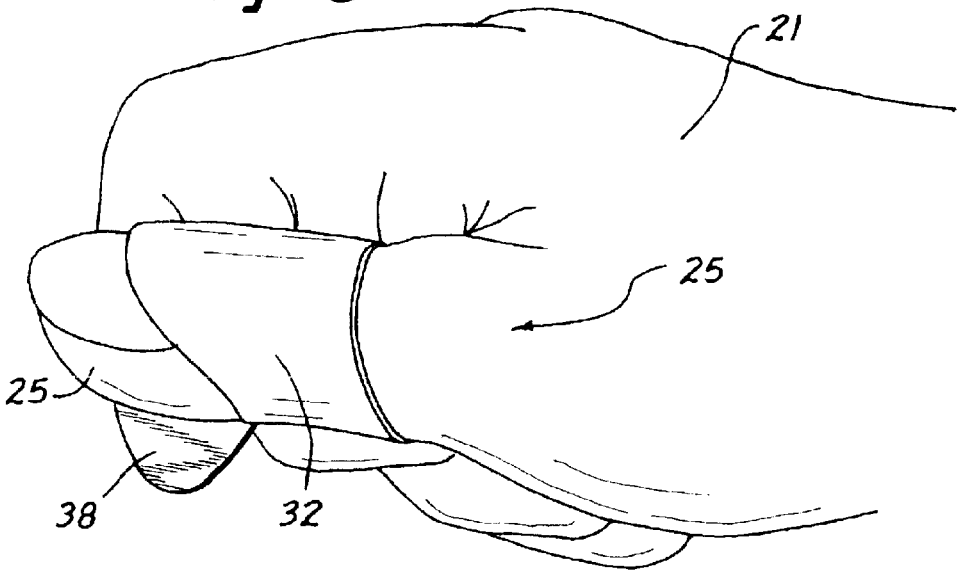

Fig. 10
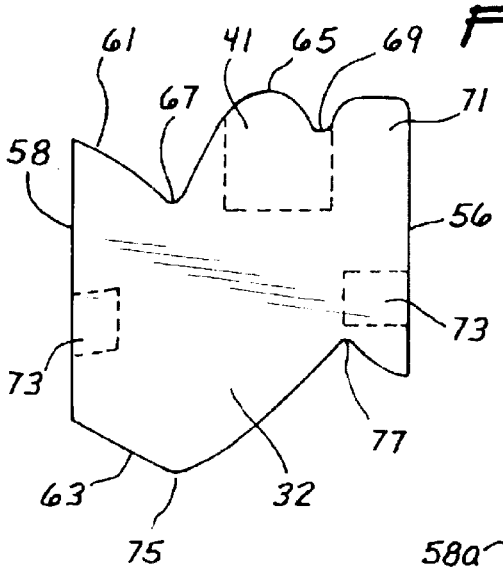
Fig. 11
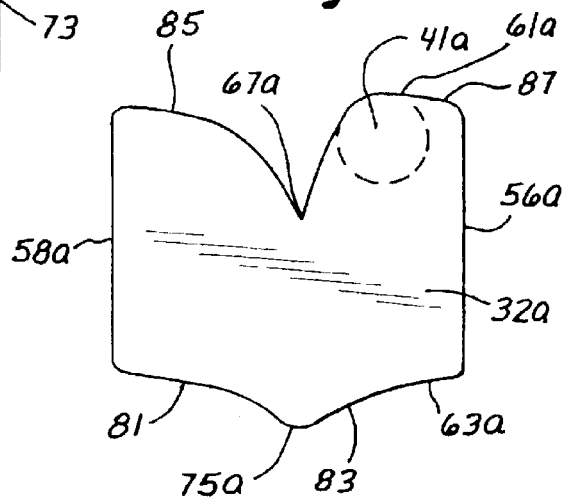
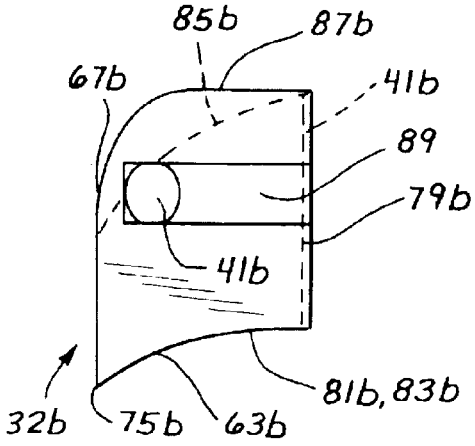
Fig. 13
Fig. 12
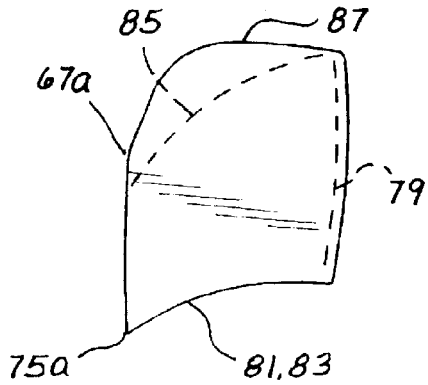

Fig. 17
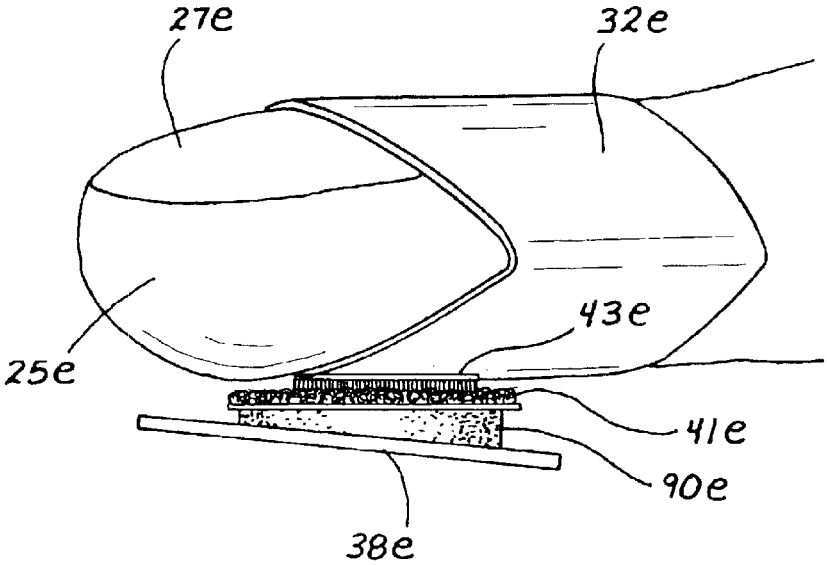
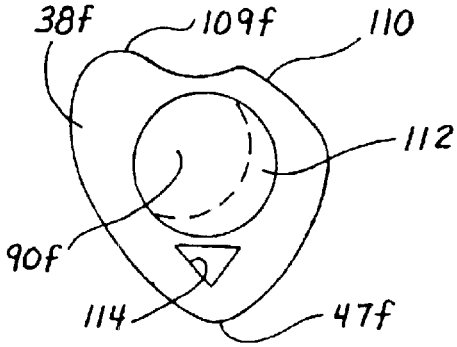
Fig. 18
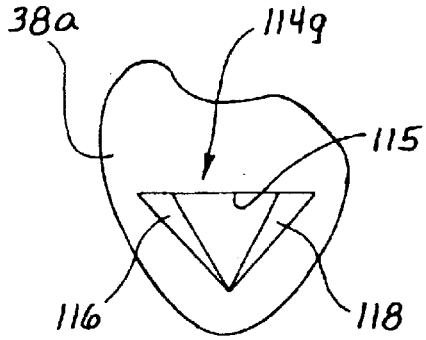
Fig. 19

STRINGED INSTRUMENT STRUMMING/PICKING APPARATUS AND METHOD

BACKGROUND OF THE INVENTION

1. Field of the Invention

This invention relates generally to apparatus and methods for strumming/picking stringed instruments.

2. Discussion of the Prior Art

The use of a pick to strum or pick a stringed instrument, such as a guitar, is well known. Picks have been provided in a variety of sizes, shapes, and materials typically adapted to be held on the thumb or between the finger and thumb of a user.

There are several styles used for strumming a stringed instrument, such as a guitar. Included among these various styles are the flat-picking style which uses a pick, and a style referred to as "finger style", which does not use a pick. The preferred style often varies depending on the posture of the player. Thus the player may be standing with the instrument hanging from a neck strap, sitting with the instrument resting on the right leg, or in the classic style, sitting with the instrument resting on the left leg. In all of these styles, a pick may be used. However, particularly in the classic mode, finger style is generally preferred. Current flat-picks and thumb picks are less compatible with this classical style due to the strumming/picking angle, the angle between the strumming/picking path and the strings.

In the present day there is an increasing trend among guitarists to work with both flat-pick and finger style methods. Although there are many workbooks on the market which teach both techniques, they are usually segregated. There is an advanced flat-pick method, however, which demonstrates the use of the second, third and little finger for picking while gripping the pick between the thumb and first finger. In another method, the guitarist magically palms the flat-pick in order to use all of the fingers. Both of these latter two methods are advanced styles and are very difficult to master and can be restrictive.

Nevertheless it can be appreciated that there is an increasing interest in combining flat-pick and finger style methods in order to achieve all of the possible variations in sound, tactile feel, flexibility and a challenge.

SUMMARY OF THE INVENTION

In accordance with the present invention, a thumb sleeve is provided with attachment means, such as hook and loop patches, which can be used to attach a pick to the thumb sleeve. The attachment means is initially preferred because it prevents movement of the pick between sweaty fingers. The pick need not be held with a pressure so great that it limits the resulting tonal quality. In addition, the attachment means facilitates positioning the pick between an extended position and a retracted position. Thus the pick can be extended to facilitate use in the flat-picking method and retracted to free all fingers for finger style play. Specially configured picks can be provided in accordance with this invention to facilitate use with the thumb sleeve. In addition, a pivot pad, typically made of felt, can be formed for example with a compound taper, and attached to the pick for use with or without the thumb sleeve. The tapered pad will facilitate a preferred disposition of the pick relative to the strings in accordance with the guitar holding style and the playing style desired by the player.

In one aspect of the invention, a pick apparatus is adapted for use in strumming strings of a musical instrument. The apparatus includes a pick adapted to be held by a user and to be moved in a contacting and strumming relationship with the strings of the instrument. A thumb sleeve is adapted for disposition on the thumb of a user and includes attachment means having a first structure carried by the sleeve and a second structure carried by the pick. The attachment means is adapted for releasably attaching the pick to the sleeve. The attached pick is moveable by the fingers of the user between a first position and a second position spaced from the first position on the meatus of the thumb.

In another aspect of the invention, a pick combination is adapted for use in strumming strings of a musical instrument. The combination includes a pick having a first surface and a second surface opposing the first surface. A pivot pad has a third surface and a fourth surface opposing the third surface. The third surface of the pivot pad is attached to the first surface of the pick and the fourth surface of the pivot pad is disposed with an angular relationship to the third surface of the pad.

In another further aspect of the invention a pick pad is adapted for attachment to a stringed instrument pick. The pad includes a first major surface and a second major surface, and is formed with an axis extending between a front edge of the pad and a back edge of the pad. The axis is disposed to generally bifurcate the pad into equivalent areas of the pad. The first surface of the pad includes a first taper extending generally along the axis and a second taper extending generally transverse to the axis. Means is disposed on the second major surface of the pad for attaching the pad to the stringed instrument pick.

These and other features and advantages of the invention will become more apparent with a description of preferred embodiments and reference to the following drawings.

DESCRIPTION OF THE DRAWINGS

FIG. 4 is perspective view of a finger sleeve of the present invention mounted on a thumb of a user;

FIG. 5 is a perspective view showing attachment means on the thumb sleeve and an associated pick facilitating attachment of the pick to the sleeve;

FIG. 6 is a perspective view showing the pick in an extended position for use in a flat-picking style;

FIG. 10 is a top plan view of a preferred embodiment of the thumb sleeve prior to formation of the sleeve in a tubular configuration;

FIG. 11 is a plan view of an additional embodiment similar to FIG. 10 of the thumb sleeve;

FIG. 12 is a perspective view of the embodiment of FIG. 11 formed into its tubular configuration;

FIG. 13 is a perspective view of a further embodiment of the thumb sleeve including a Velcro pad attached to an elastic member;

FIG. 17 is a perspective view of a thumb sleeve, a pick pad and Velcro attachment means of the present invention;

FIG. 18 is a top plan view of a further embodiment of a pick associated with the present invention;

FIG. 19 is a top plan view of a further embodiment of a pick associated with the present invention;

DESCRIPTION OF PREFERRED EMBODIMENTS AND BEST MODE OF INVENTION

Figure 1:
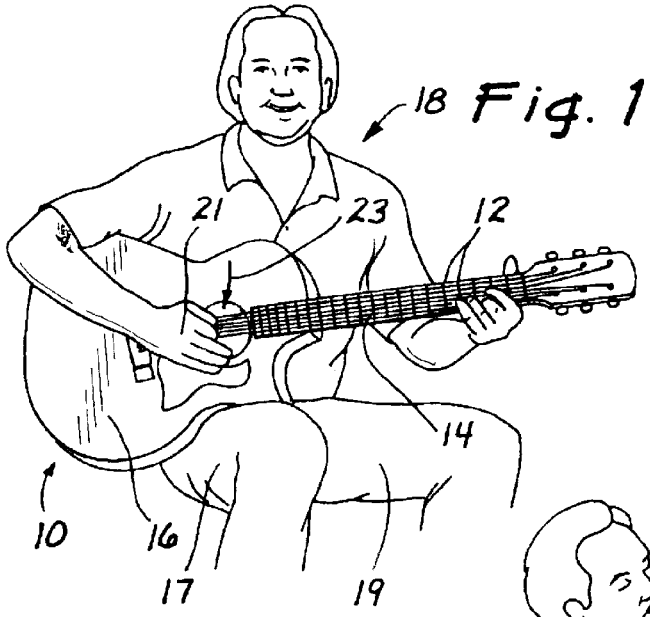
FIG. 1 is a perspective view of a guitar positioned on the right leg of a user with the guitar held in a generally horizontal configuration.

A guitar is illustrated generally in FIG. 1 and designated by the reference numeral 10. This guitar 10 is merely representative of many types of musical instruments which include strings 12, extending along a neck 14, and anchored at a box 16 which may be hollow and/or include an electronic pickup (not shown).

The position of the guitar 10 and strings 12 is dictated primarily by the neck or fingerboard 14 and its relationship to the horizontal. Thus, in FIG. 1, the guitar 10 is held in a generally horizontal configuration and balanced on the right leg 17 of a player 18. This horizontal configuration is also common when the player 18 is standing and the guitar 10 is supported by a neck strap (not shown). In FIG. 1 it can be seen that the player 18 has a hand 21 which is moved along a strum path designated by the reference number 23.

Figure 2:
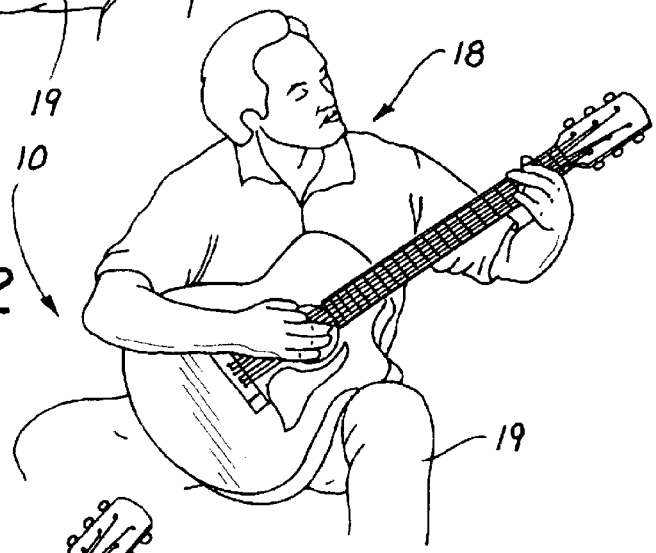
FIG. 2 is a perspective view of a guitar balanced on the left leg of the user and held at an angle to the horizontal.

In FIG. 2 the guitar 10 is held at a slight angle to the horizontal as it is balanced on a left leg 19 of the user 18. Finally, in FIG. 3 the guitar 10 is illustrated to be held at an advanced angle to the horizontal with the guitar 10 balanced on the left leg 19 of the user 18. This orientation illustrated in FIG. 3 is commonly used in the classical style of play.

Figure 3:
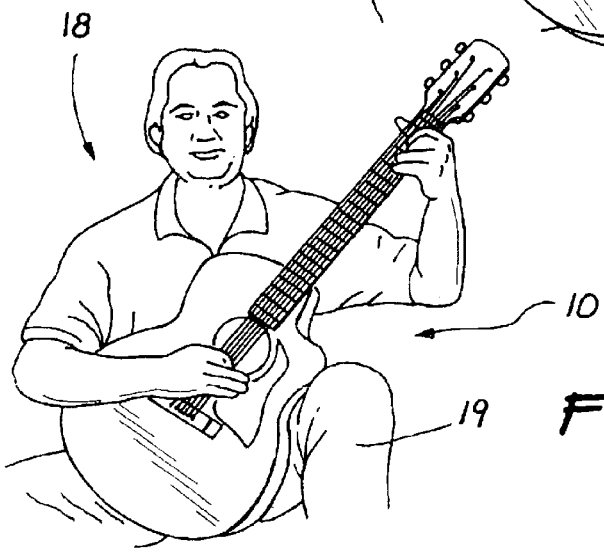
FIG. 3 is perspective view of a guitar held in a classical style at an advanced angle to the horizontal.

In each of the playing orientations illustrated in FIGS. 1–3, it can be seen that the angle of the strum path 23 relative to the strings 12 varies with the orientation of the guitar 10.

However, this is only one of the variables which ultimately results in the sound achieved when a particular one of the strings 12 is strummed. When a pick is held in the hand 21 of the player 18, its physical characteristics also affect the sound. Thus, the material, the thickness of the pick, as well as its flexibility and the grip intensity will not only affect the sound but also the tactile feedback to the hand 21 of the player 18.

This tactile feedback is even further increased in the finger style of play where no pick is brought into contact with the string. In this finger style of play, the meatus of the thumb and fingers of the hand 21 are used to individually pluck the strings 12 or collectively strum the strings 12.

A thumb 25 on the hand 21 of the player 18 is illustrated in the perspective view of FIG. 4. In this view it can be seen that the thumb 25 has a longitudinal configuration and extends to its end which includes a nail 27 on one side and a meatus 29 on the other side. In this common configuration of the thumb 25, the meatus 29 or thumbnail is brought into direct strumming contact with the strings 12 in the finger style of play.

In accordance with the present invention, a thumb sleeve 32 is provided for disposition on the thumb 25 as illustrated in FIG. 4. The sleeve 32 is disposed generally over a first knuckle 34 of the thumb 25 but leaves portions of both the nail 27 and meatus 29 exposed to facilitate the finger style of play. An attachment means 36 such as a hook and loop pad system, commonly referred to as Velcro (a trademark of Velcro Industries), can be used to adhere a pick 38 to the sleeve 32. In the embodiment illustrated in FIG. 5, an attachment means 36 includes a loop pad 41 attached to the sleeve 32 in proximity to the meatus 29 of the thumb 25. The attachment means 36 also includes a hook pad 43 which is attached to the pick 38. In operation, the hook pad 43 and associated pick 38 are brought into engagement with the loop pad 41 and associated sleeve 32 as illustrated in FIG. 6.

Figure 7:
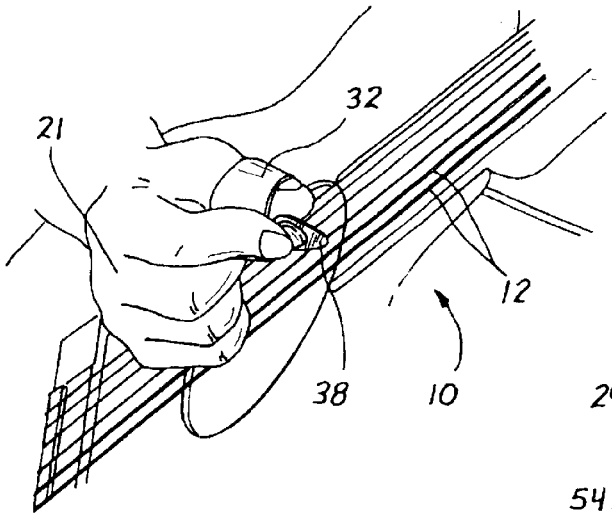
FIG. 7 is a perspective view of the pick in the extended position and applied to the strings of the guitar.

The placement of the pick 38 relative to the sleeve 32 is of particular interest to the present invention. When the attachment means 36 is embodied with the loop and hook pads 41 and 43, respectively, the pick 38 can be placed in generally any position and orientation relative to the meatus 29 of the thumb 25. In FIG. 6, the pick is illustrated to be attached in an extended position where it can be held in place between the first finger and thumb 25 of the hand 21. In this extended position, the pick 38 is positioned to facilitate the flat-pick style of play. This style is further illustrated in FIG. 7 where the pick 38 in the extended position is easily brought into contact with the strings 12 of the guitar 10.

Figure 8:
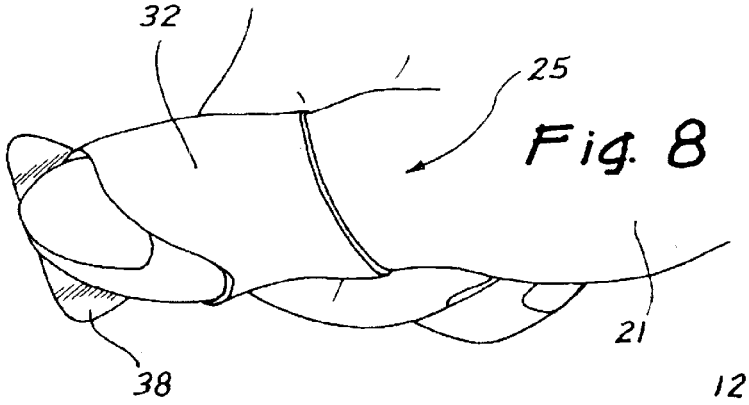
FIG. 8 is a perspective view of the user's thumb showing the sleeve and the pick in a retracted position facilitating the finger style of play.

Particularly with the hook and loop attachment means 36, the pick 38 can be reoriented relative to the sleeve 32. For example, the pick 38 might be moved from the extended position as illustrated in FIG. 6 to a retracted position as illustrated in FIG. 8. In this retracted position, the pick 38 remains in contact with the sleeve 32 for future reorientation, but is sufficiently removed from the nail 27 and meatus 29 of the thumb 25 so that strumming is facilitated in the finger style of play. This style is further illustrated in FIG. 9 where it can be seen that the pick 38 remains with the sleeve 32 but is sufficiently removed from the meatus 29 to permit strumming of the strings 12 directly with the fingers and thumb 25.

Figure 9A:
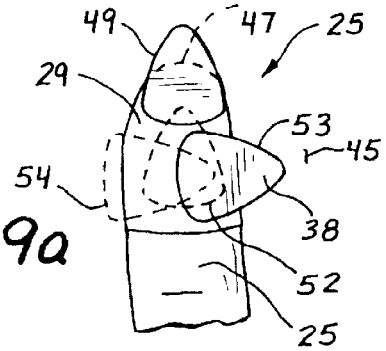
FIG. 9*a* is a bottom plan view of a user's thumb showing various orientations of the pick.
Figure 9:
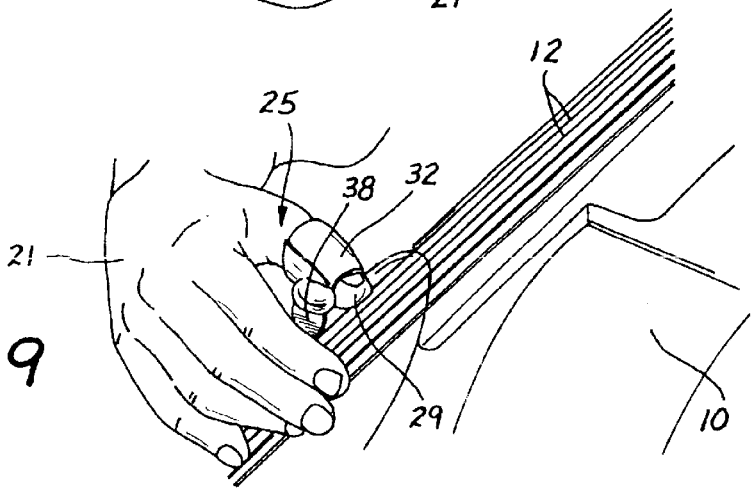
FIG. 9 is a perspective view showing the pick in the retracted position with the fingers of the user strumming the guitar.

A bottom plan view of the underside of the thumb 25 is illustrated in FIG. 9*a*. In this view it can be seen that the thumb 25 is disposed generally in a thumb plane 45 (the plane of the page in FIG. 9*a*) and has a longitudinal configuration which extends to a tip 47. With reference to this view it can be seen that the placement of the pick 38 in the extended and retracted positions may vary considerably with the holding position of the guitar 10 and strumming style of the player 18.

In general the pick 38 will be moved between these two positions laterally in a plane generally parallel to the plane of the thumb 25. However, the extended position may be longitudinally spaced from the retracted position along the meatus of the thumb. Thus, the pick 38 may be moved from an extended position at the tip 47, designated by the solid lines 49, to a retracted position spaced longitudinally, as shown by the dotted lines 52.

Alternatively, the extended and retracted positions may be spaced transverse to the longitudinal dimension of the thumb 25. In such a case the extended position might be that designated by the solid line 53; the retracted position might be that shown by the dotted lines 54. The pick 38 in the extended position will be disposed in a plane generally parallel to the thumb plane 45. In the retracted position, the plane of the pick 38 may be either parallel to or transverse to the thumb plane 45.

Although this embodiment has been described with an attachment means including hook and loop pads 43 and 41, respectively, it will be appreciated that the attachment means 36 may include any other structure adapted to hold the pick 38 in contact with the sleeve 32 while permitting the movement of the pick 38 between an extended position and a retracted position. Thus, for example, the attachment means 36 might include an adhesive or an adhesive tape applied to either one or both of the pick 38 and the sleeve 32.

The sleeve 32 and its method of manufacture are of particular interest to the present invention. One embodiment of the sleeve 32 is illustrated in FIG. 10 in a top plan or cutout view. In this case, the sleeve 32 will typically be formed from sheet material which is generally flexible and may be formed from a fabric and/or a resilient material such as foam rubber. Such materials are commonly used for example in the manufacture of polypropylene gloves. A sheet material including elastic foam may offer further advantages to a particular embodiment as discussed in greater detail below.

In FIG. 10, the plan or cutout view illustrates that the sleeve 32 can be provided with two generally parallel edges 56 and 58. After the sleeve 32 is cut from the sheet material, these edges 56 and 58 can be brought into proximity to form the sleeve 32 into a tubular configuration. Between the edges 56 and 58, the sheet material can be cut along a first line 61 and a second line 63 spaced from the first line 61. In this embodiment, the first line 61 is provided with a peak 65, with a deep valley 67 on one side and a shallow notch 69 on the other side. Between the notch 69 and the edge 56, a flap 71 is formed for attachment to the opposing edge 58. Hook and loop patches, or other coupling means 73, can be attached to this flap to facilitate the tubular formation.

In this embodiment, the second line 63 can be formed with a peak 75, which is generally equally spaced to the edge 58 with the valley 67, and a valley 77 which is generally equally spaced from the edge 56 with the notch 69. Once the sleeve 32 is formed into its tubular configuration, the deep valley 67 exposes the side of the nail 27 and meatus 29 of the thumb 25 as shown in FIG. 4. The peak 75 along the second line 63 provides a tab which the player 18 can grasp with the other hand in order to pull the sleeve 32 onto the thumb 25.

A further embodiment of the invention is illustrated in FIGS. 11 and 12 where elements of structure similar to those previously discussed will be referred to in the same reference numeral followed by the lower case letter "a." Thus, in the plan cutout view of FIG. 11, the opposing parallel edges are designated with reference numerals 56*a* and 58*a*. The first line 61*a* is similar to the embodiment of FIG. 10 in that it includes a valley 67*a*. Likewise, the bottom line 63*a* includes a peak 75*a*. In this case, however, the valley 67*a* and peak 75*a* are generally equidistant from both of the edges 56*a* and 58*a*. The attachment means 73*a*, such as the loop patch 41*a*, can be sewn or adhered to the fabric or backing of the sleeve 32*a*.

In a typical manufacturing process, the backing could be cut from sheets of the fabric material and screen printed with a design on the finished side of the material. The material can then be folded in half with the design on the inside and the edges 56*a* and 58*a* aligned coextensively. A seam 79 could then be sewn along the edges 56*a* and 58*a* to form a lap joint or otherwise joined to create the tubular configuration of the sleeve 32*a*. The sleeve 32*a* could then be turned inside out in order to display the design side and pattern. The resulting product would appear generally as illustrated in FIG. 12. With the seam 79 on one side of the sleeve 32*a*, the valley 67*a* and peak 75*a* would be disposed on the opposite side of the sleeve 32*a*.

In this embodiment of the sleeve 32*a*, the second line 63*a* is divided by the peak 75*a* into a first line 81 and a second line 83 which are similar in shape and orientation. When the seam 79 is formed, these lines 81 and 83 are substantially coextensive along the bottom edge 63*a* of the sleeve as shown in FIG. 12.

This is not the case with the edge 61*a* which is divided into lines 85 and 87 which are dissimilar in shape. The line 85 is closer to the line 81 and therefore defines a more narrow portion of the sleeve 32*a*. By comparison, the line 87 is further from the line 83 and therefore defines a wider portion of the sleeve 32*a*. The relative shape and position of the lines 81–87 is best illustrated in the view of FIG. 12.

A further embodiment of the invention is illustrated in FIG. 13 where elements of structure similar to those previously discussed are designated with the same reference numeral followed by the lower case letter "b". This embodiment is similar to that illustrated in FIG. 12 in that it includes the bottom edge 63*b* formed by the lines 81*b* and 83*b*, as well as the sewn seam 79*b*. This embodiment also includes the top edge formed by the lines 85*b* and 87*b*. In this embodiment, however, an elastic strip 89 is provided and sewn to the thicker portion of the sleeve 32*b* between the lines 83*b* and 87*b*. This elastic strip 89 is oriented generally perpendicular to the sewn seam 79 as illustrated in FIG. 13. In this particular embodiment, the elastic strip 89 is sewn into the seam 79 but is otherwise free to move relative to the sleeve 32*b*. At the opposite end of the elastic strip 89, the loop patch 41*b* can be attached to the strip 89.

In operation, the user would then attach the pick 38 to the loop pad 41*b*. When flat-picking was desired, the user would merely push the pick forward stretching the elastic strip 89. This would move the pick to the extended position and facilitate flat-picking. Then, if the user desired to transition to a finger picking style, the pick could merely be released permitting the elastic strip 89 to withdraw the pick to a retracted position such as that illustrated in FIG. 8. Thus the pick would always stay with the finger sleeve 32*b*, but it would be manually movable to the extended position and automatically movable to the retracted position.

It has been found that changes in playing style as well as guitar orientation, may require adjustments in the angle of the pick 38 relative to the thumb 25 in order to maintain tonal quality. In order to facilitate changes in angle, a pivot pad can be provided such as that illustrated in FIG. 14*a* and designated by the reference numeral 90. Such a pad 90 can be attached generally to any flat pick to facilitate angle variations and more importantly provide freedom of technique. The pivot pad 90 is also adapted for use with the sleeve 32 as shown and described in greater detail with reference to FIG. 17. In this combination, the pivot pad 90 also functions to permit manipulation of the pick 38 relative to the thumb 25 of the user.

A particular embodiment of the pivot pad 90 is formed of a hard felt material and includes a first major surface 92 which may have a planar configuration, and a second major surface 94 which may have a contoured configuration including a planar portion 95 and a bump or berm 96. The pivot pad 90 has a generally fat configuration with convex edges 98 and 101 which meet at corners 103 and 105. The planar portion 95 of the major surface 94 is disposed at a slight angle to the plane of the major surface 92, and is positioned generally along the edge 98 and closer to the corner 103. The berm 96 is positioned generally along the edge 101 and closer to the corner 105. The berm 96 has its highest point in proximity to the corner 105. From this point it slopes downwardly to the corner 103 and downwardly toward the edge 98. A self-stick base 107 will typically be provided on the major planar surface 92 to facilitate adherence to the pick 38. Such an embodiment is illustrated in FIG. 15.

It will be appreciated that the pivot pad 90 can be provided with many different configurations and shapes. Generally, the two major surfaces 92 and 94 will be non-parallel. For example, they both may be planar surfaces disposed at some slight angle with respect to each other as illustrated in FIG. 15. Alternatively, as in the embodiment illustrated in FIG. 14*a*, the major surface 94 may be contoured meaning that it is non-planar. Placement of the points of greatest thickness or highest elevation, such as the bump or berm 96, will also vary to provide the advantages desired for a particular embodiment.

Figure 15:
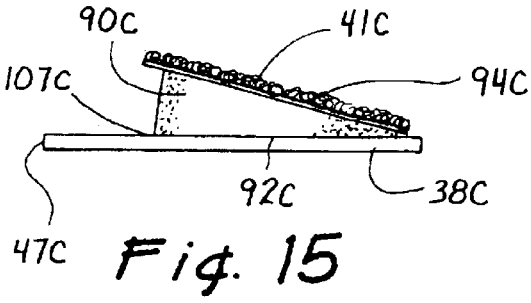
FIG. 15 is a side elevation view of a pick pad and Velcro attaching means of the present invention.

In the embodiment of FIG. 15, elements of structure similar to those previously discussed are designated with the same reference numeral followed by the lowercase letter "c." In this embodiment, the pick 38*c* is illustrated in a side elevation view to show the tip 47*c* and the pivot pad 90*c* with its major surfaces 92*c* and 94*c*. The major surface 92*c* is adhered to the pick 38*c* with a self-stick base 107*c* such as adhesive. The opposite surface 94*c* of the pad 90*c* is provided with the attachment means such as the loop pad 41*c*.

Figure 14A:
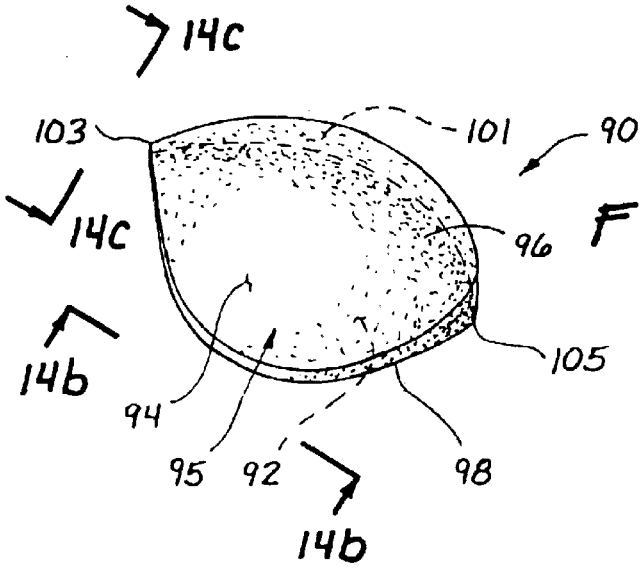
FIG. 14*a* is a top plan view of a pad adapted for mounting on a pick.
Figure 14B:
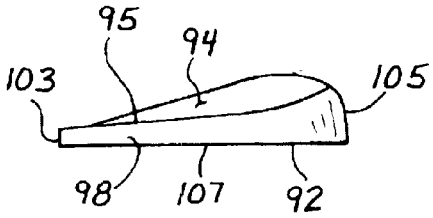
FIG. 14*b* is a side elevation view taken along lines 14*b*—14*b* of FIG. 14*a;*
Figure 14C:
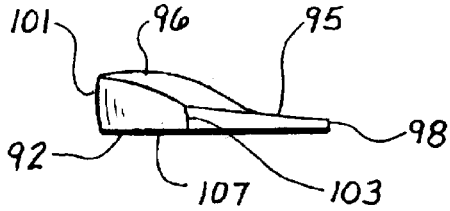
FIG. 14*c* is a side elevation view taken along lines 14*c*—14*c* of FIG. 14*a;*
Figure 16:
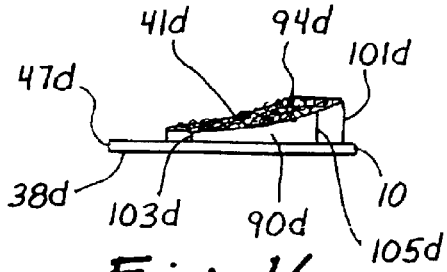
FIG. 16 is a top plan view of a pick combination associated with the present invention.

A further embodiment is illustrated in FIG. 16 where elements of structure similar to those previously discussed are designated with the same reference numeral followed by the lower case letter "d." In this embodiment, the pivot pad 90*d* is generally that illustrated in FIGS. 14*a–c*. Thus it includes the major surface 94 with the contour configuration. This pad 90*d* together with the loop pad 41*d* is adhered to the pick 38*d* in the manner previously discussed. In this case, the pick 38*d* extends from the tip 47*d* to a back edge 109. Tonal quality as well as flexibility can be achieved by tapering the pick 38*d* generally from the tip 47*d* to the back edge 109.

These embodiments of FIGS. 15 and 16 with the hook pads 43*d* are particularly adapted for use with the sleeve as illustrated in FIG. 17. In this view, elements of structure similar to those previously discussed are designated by the same reference numeral followed by the lower case letter "e." Thus, the thumb 25*e* and nail 27*e* of the user are illustrated with the sleeve 32*e* operatively disposed. The hook pad 43*e* mounted on the sleeve 32*e* is operatively attached to the loop pad 41*e* on the pivot pad 90*e* and the pick 38*e*.

FIG. 18 illustrates a top plan view of a flat pick configured to facilitate use in multiple playing styles and guitar orientations. In this view, elements of structure similar to those previously discussed are designated with the same reference numeral followed by the lower case letter "f." Thus, the pick 38*f* includes the tip 47*f* as well as the back edge 109*f*. In this case, the back edge is provided with a chamfer 110 which provides clearance for the first finger on the user's hand. The pivot pad 90*f* is provided with a first finger leverage arch 112 which is disposed on side of pick 38*f* opposite the pivot pad 90*f*. A triangular-shaped hole 114 can be provided near the tip 47*f* to facilitate a pick configuration having a thicker tip 47*f* for better tonal quality, without sacrificing a high degree of flexibility.

A further embodiment of the pick is illustrated in FIG. 19 where elements of structure similar to those previously discussed are designated with the same reference numerals followed by the lower case letter "g." In this embodiment, the triangular hole 114*g* is defined by a back surface 115 generally perpendicular to the plane of the pick 38*g*, and a pair of side surfaces 116 and 118 which are disposed generally transverse to the plane of the pick 38*g*. With this construction, wide variations in the thickness and flexibility of the pick 38*g* can be controlled by the shape and size of the hole 114*g* as well as the configuration and size of the transverse side surfaces 116 and 118.

Figure 20:
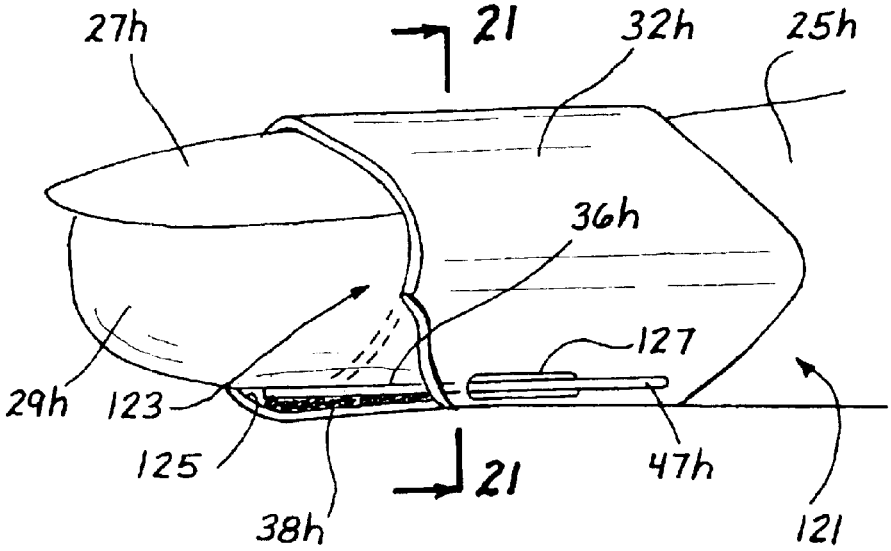
FIG. 20 is a perspective view of another embodiment of the thumb sleeve with a pick and attachment means disposed interiorly of the sleeve.
Figure 21:
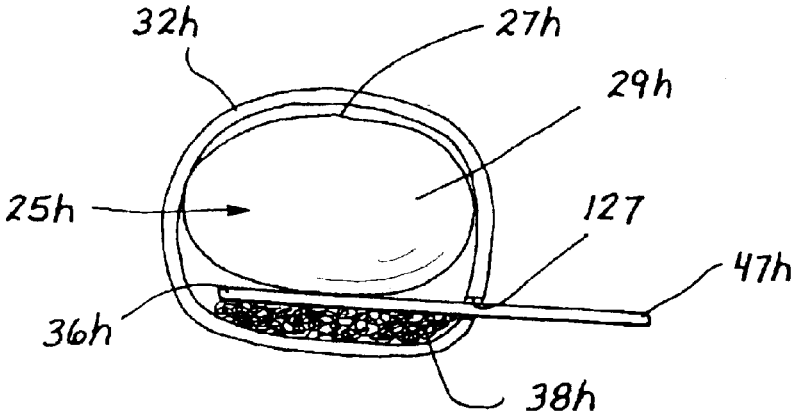
FIG. 21 is a cross-section view taken along lines 21—21 of FIG. 20.

A further embodiment of the invention is illustrated in FIGS. 20 and 21 where elements of structure similar to those previously disclosed are designated by the same reference numeral followed by the lower case letter "h." Thus, FIG. 20 illustrates the thumb 25*h* with the associated nail 27*h* and meatus 29*h*. The thumb sleeve 32*h* is provided in a tubular configuration with a proximal opening 121 and distal opening 123. In FIG. 20, a portion of the sleeve 32*h* has been removed to illustrate the interior regions of the sleeve 32*h*. These regions are defined by an inner surface 125 of the sleeve 32*h* which extends between the openings 121 and 123. In this embodiment, a lateral opening 127 in also provided in the sleeve 32*h*.

In this case, the attachment means 36*h* is mounted on the inner surface 125 interiorly of the sleeve 32*h*. The pick 36*h* is also disposed interiorly of the sleeve 32*h* where it is held to the sleeve 32*h* by the attachment means 38*h*. The tip 47*h* of the pick 36*h* extends through the hole 127, in the side of the sleeve 32*h*. Thus the tip 47*h* is the only portion of the pick 36*h* which extends exteriorly of the sleeve 32*h*. Of course several lateral holes, such as the hole 127 could be provided in the sleeve 32*h* to accommodate different positions of the tip 47*h* relative to the thumb 25*h*. The tip 47*h* could even be mounted to extend through the distal hole 123 of the sleeve 32*h*.

From the foregoing description of preferred embodiments, it will be apparent that many of the advantages associated with the present invention relate to the shape, size, contour and material of various elements of structure. Of course these shapes, sizes, contours and materials can all be varied slightly to provide the specific advantages discussed above. For this reason, one is cautioned not to limit the concept only to those embodiments disclosed, but rather to determine the scope of the invention only with reference to the following claims.

What is claimed is:

1. A pick combination adapted for use in strumming/picking strings of a musical instrument, comprising:

a pick having a first surface and a second surface opposing the first surface;

a thumb pad attached to the first surface of the pick;

the thumb pad having a third surface attached to the first surface of the pick; and the thumb pad having a fourth surface opposing the third surface and having an angular relationship with the third surface of the pad.

2. The pick combination recited in claim 1, wherein:

the pick has a tip and a back edge disposed in proximity to the tip of the pick and a second edge disposed in proximity to the back edge of the pick; and the first edge of the pad is thinner than the second edge of the pad.

3. The pick combination recited in claim 2, wherein the pick is tapered from the tip of the pick to the back edge of the pick.

4. The pick combination recited in claim 2, wherein the pick is thicker at the tip than at the back edge.

5. The pick combination recited in claim 2, further comprising:

a pair of side edges extending from the tip of the pick to the back edge of the pick; and at least one of the side edges being convex and at least a portion of the back edge being concave.

6. The pick combination recited in claim 1, wherein:

the pick extends longitudinally along a first line extending between the tip and the back edge of the pick;

the pad is tapered along a second line extending between a first edge of the pad and a second edge of the pad; and the second line of the pad is transverse to the first line of the pick.

7. The pick combination recited in claim 6, wherein the first edge of the pad is disposed on one side of the first line and the second edge of the pad is disposed on the other side of the first line.

8. The pick combination recited in claim 7, wherein:

the first surface of the pick is disposed in a first plane; and the second surface of the pick is disposed in a second plane having an angular relationship with the first plane.

9. The pick combination recited in claim 1 further comprising:

a sleeve having a tubular configuration and extending longitudinally between a proximal opening and a distal opening, the sleeve having an exterior surface, and an interior surface defining an interior region of the sleeve;

the pick having a tip and being disposed relative to the sleeve with the tip extending exteriorly of the sleeve; and attachment means for removably coupling the pick to the sleeve.

10. The pick combination recited in claim 9, wherein the attachment means and the pick are disposed exteriorly of the sleeve.

11. The pick combination recited in claim 9, wherein the attachment means and the pick are disposed in the interior region of the sleeve with the tip of the pick projecting exteriorly of the sleeve.

12. The pick combination recited in claim 11, wherein the tip of the pick extends through the distal opening of the sleeve.

13. The pick combination recited in claim 11, wherein:

portions of the sleeve define a lateral hole extending through the sleeve; and the tip of the pick extends exteriorly of the sleeve through the lateral hole.

14. The pick combination as recited in claim 1, and adapted for use by a user having a thumb with a meatus, further comprising:

the pick adapted to be held by the user and to be moved in a contacting and strumming relationship with the strings of the musical instrument;

a thumb sleeve adapted for disposition on the thumb of the user;

attachment means including a first structure carried by the sleeve and a second structure carried by the pick, the attachment means being adapted for releasably attaching the pick to the sleeve; and the attached pick being moveable by the fingers of the user between a first position and a second position spaced from the first position on the meatus of the thumb.

15. The pick combination recited in claim 14, wherein:

the thumb is disposed generally in a plane and has a tip and a longitudinal configuration; and the first position is laterally spaced from the second position on the meatus of the thumb.

16. The pick combination recited in claim 15, wherein:

the pick in the first position has a first angle relative to the plane of the thumb; and the pick in the second position has a second angle different than the first angle relative to the plane of the thumb.

17. The pick combination recited in claim 16, wherein:

the first position is an extended position; and the second position is a retracted position.

18. The pick combination recited in claim 17, further comprising:

means for biasing the pick to the second position.

19. The pick combination recited in claim 14, wherein in the thumb is disposed generally in a plane and has a tip and a longitudinal configuration; and the first position is longitudinally spaced from the second position on the meatus of the thumb.

20. The pick combination recited in claim 15, wherein:

the pick in the first position is disposed in a proximal relationship to the tip of the thumb; and the pick in the second position is disposed in a spaced relationship with the tip of the thumb.

21. A pick pad adapted for attachment to a stringed instrument pick, comprising:

a pad including a first major surface and a second major surface formed with an axis extending between a front edge of the pad and a back edge of the pad;

the axis generally bifurcating the pad into generally equivalent areas of the pad the first surface of the pad including a first taper extending generally along the axis and a second taper extending generally transverse to the axis; and means disposed on the second major surface of the pad for attaching the pad to the stringed instrument pick.

22. The pick pad recited in claim 21, wherein the pad is formed of felt.

23. The pick pad recited in claim 21, wherein the pad is formed of a resilient material.

24. The pick combination recited in claim 1, and adapted for use by a user having a thumb with a meatus, further comprising:

the pick adapted to be held by the user and to be moved in a contacting and strumming relationship with the strings of the musical instrument;

a thumb sleeve adapted for disposition on the thumb of the user;

attachment means including a first structure carried by the sleeve and a second structure carried by the pick, the attachment means being adapted for releasably attaching the pick to the sleeve;

the attached pick being moveable by the fingers of the user between a first position and a second position spaced from the first position on the meatus of the thumb;

wherein the pick has a generally planar configuration and the combination further comprises:

a pad disposed on the side of the pick opposite the attachment means; and the pad having a first surface generally parallel to the plane of the pick and a second surface generally non-parallel to the plane of the pick.

25. The pick combination recited in claim 24, wherein the pad is tapered.

* * * * *